US010183323B2

(12) United States Patent
Neale

(10) Patent No.: US 10,183,323 B2
(45) Date of Patent: Jan. 22, 2019

(54) COOLING OF TURBINE BLADES AND METHOD FOR TURBINE BLADE MANUFACTURE

(71) Applicant: ROLLS-ROYCE plc, London (GB)

(72) Inventor: Christopher Neale, Bristol (GB)

(73) Assignee: ROLLS-ROYCE plc, London (GB)

( * ) Notice: Subject to any disclaimer, the term of this patent is extended or adjusted under 35 U.S.C. 154(b) by 454 days.

(21) Appl. No.: 15/217,190

(22) Filed: Jul. 22, 2016

(65) Prior Publication Data

US 2017/0136525 A1 May 18, 2017

(30) Foreign Application Priority Data

Aug. 20, 2015 (GB) ..... 1514793.7

(51) Int. Cl.
*B22C 9/10* (2006.01)
*B22C 9/24* (2006.01)
(Continued)

(52) U.S. Cl.
CPC ..... *B22C 9/10* (2013.01); *B22C 9/24* (2013.01); *B22D 25/02* (2013.01); *B22D 29/001* (2013.01);
(Continued)

(58) Field of Classification Search
CPC .. B22C 9/10; B22C 9/24; B22D 25/02; F01D 5/18; F01D 5/187; F01D 9/041; F01D 9/065
See application file for complete search history.

(56) References Cited

U.S. PATENT DOCUMENTS 5,243,759 A 9/1993 Brown et al.
5,394,932 A * 3/1995 Carozza ..... B22C 1/00 164/137
(Continued)

FOREIGN PATENT DOCUMENTS

EP 1553261 A2 7/2005
EP 1715139 A2 10/2006
(Continued)

OTHER PUBLICATIONS

Dec. 14, 2016 Search Report issued in European Patent Application No. 16180562.
(Continued)

*Primary Examiner* — Kevin E Yoon
(74) *Attorney, Agent, or Firm* — Oliff PLC

(57) ABSTRACT

Method for casting a turbine component body including; providing a mould defining the external geometry of the component body and providing a core defining an internal geometry of the component body. The core includes a main body defining an internal chamber of the component body and an array of pedestals extending between opposing walls of the internal chamber. A molten material is cast between the mould and the core and the core is then removed after the molten material has solidified. The core is provided using a core die which has an inlet for receiving fluid core material. The core die is configured such as to provide a gradient of injection pressure which decreases from a first position proximal to the inlet to a second position distal to the inlet. The pedestal array is arranged such that the separation of the pedestals increases between the first and second positions.

15 Claims, 8 Drawing Sheets

(51) Int. Cl.

| | |
|---|---|
| ***B22D 25/02*** | (2006.01) |
| ***B22D 29/00*** | (2006.01) |
| ***F01D 5/18*** | (2006.01) |
| ***F01D 9/04*** | (2006.01) |
| *F01D 9/06* | (2006.01) |

(52) U.S. Cl.

CPC ..... *F01D 5/18* (2013.01); *F01D 9/041* (2013.01); *F01D 5/187* (2013.01); *F01D 9/065* (2013.01); *F05D 2220/32* (2013.01); *F05D 2230/21* (2013.01); *F05D 2240/122* (2013.01); *F05D 2240/304* (2013.01); *F05D 2250/141* (2013.01); *F05D 2250/75* (2013.01); *F05D 2260/2212* (2013.01); *F05D 2260/2214* (2013.01)

(56) References Cited

U.S. PATENT DOCUMENTS

| | | | | |
|---|---|---|---|---|
| 5,465,780 | A | 11/1995 | Muntner et al. | |
| 6,602,047 | B1 * | 8/2003 | Barreto | F01D 5/187 415/1 |
| 2005/0135933 | A1 * | 6/2005 | Gregg | F01D 5/16 416/108 |
| 2013/0034429 | A1 * | 2/2013 | Carter | F01D 5/187 415/178 |
| 2017/0268348 | A1 * | 9/2017 | Lee | F01D 5/189 |

FOREIGN PATENT DOCUMENTS

| | | | |
|---|---|---|---|
| EP | 1895098 | A2 | 3/2008 |
| GB | 872705 | A | 7/1961 |

OTHER PUBLICATIONS

Feb. 29, 2016 Search Report issued in British Patent Application No. GB1514793.7.

* cited by examiner

COOLING OF TURBINE BLADES AND METHOD FOR TURBINE BLADE MANUFACTURE

FIELD OF THE INVENTION

The present disclosure concerns the cooling of turbine blades. More particularly, the invention concerns the positioning of pedestals in a turbine blade for use in a gas turbine engine and a method for the manufacture of a turbine blade designed in accordance with the invention.

BACKGROUND TO THE INVENTION

In a gas turbine engine, ambient air is drawn into a compressor section. Alternate rows of stationary and rotating aerofoil blades are arranged around a common axis, together these accelerate and compress the incoming air. A rotating shaft drives the rotating blades. Compressed air is delivered to a combustor section where it is mixed with fuel and ignited. Ignition causes rapid expansion of the fuel/air mix which is directed in part to propel a body carrying the engine and in another part to drive rotation of a series of turbines arranged downstream of the combustor. The turbines share rotor shafts in common with the rotating blades of the compressor and work, through the shaft, to drive rotation of the compressor blades.

It is well known that the operating efficiency of a gas turbine engine is improved by increasing the operating temperature. The ability to optimise efficiency through increased temperatures is restricted by changes in behaviour of materials used in the engine components at elevated temperatures which, amongst other things, can impact upon the mechanical strength of the blades and a rotor disc which carries the blades. This problem is addressed by providing a flow of coolant through and/or over the turbine rotor disc and blades.

It is known to take off a portion of the air output from the compressor (which is not subjected to ignition in the combustor and so is relatively cooler) and feed this to surfaces in the turbine section which are likely to suffer damage from excessive heat. Typically the cooling air is delivered adjacent the rim of the turbine disc and directed to a port which enters the turbine blade body and is distributed through the blade, typically by means of a labyrinth of channels extending through the blade body.

Turbine blades are known to be manufactured by casting methods. A mould defines an external geometry of the turbine and a core is inserted into the mould to define the internal geometry, molten material (typically a ferrous or non-ferrous alloy) is then cast between the mould and the core and the core subsequently is removed, for example by leaching.

The core geometry defines cooling passages through which cooling air will flow within the blade body. One known means of increasing the convective cooling effectiveness of these cooling passages is to use pins or pedestals within the passages. These pedestals or pins increase the wetted area of the main cooling passages allowing more heat transfer from a main cooling passage internal face to cooling air passing through the main cooling passage. These pins or pedestals can also be used to increase pressure loss in a main cooling passage. Appropriate arrangements can serve to control the rate of cooling air leaving the main passages.

A core is injection moulded using a core die. This die represents the geometry of the blade to be cast around the core. Pedestal arrangements optimised for cooling performance, particularly when designed to achieve relatively large pressure losses, are difficult to manufacture. In manufacturing the core, it must be possible to fill the core die with core ceramic. If the pedestal arrangement has been designed solely to achieve large pressure losses in the cooling gas flow in the finished blade, it will have the same effect on the flow of ceramic into the core die. A possible consequence is poor core die fill in that area and improperly formed pedestals or passages. If the core die is not properly filled, the resulting core will not be suitable for casting a blade to the desired geometry.

In known prior art arrangements, the trailing edge of a turbine blade body is provided with one or more arrays of pins or pedestals closely aligned in parallel rows. The rows may be slightly staggered to allow the adjacent rows to be placed as close together as possible whilst maintaining structural integrity around the pins/pedestals. Dimensions of the pedestals and spacing between them are in the order of millimetres, even fractions of millimetres. Whilst such an arrangement is effective at trailing edge cooling, it presents a considerable challenge when manufacturing a core defining this internal geometry.

STATEMENT OF THE INVENTION

According to a first aspect there is provided a method for casting a turbine component body, the method comprising;

providing a mould defining the external geometry of the component body;

providing a core defining an internal geometry of the component body, the core comprising a main body defining an internal chamber of the component body and an array of pedestals extending between opposing walls of the internal chamber;

casting a molten material between the mould and the core; and removing the core after the molten material has solidified, wherein, a core die for providing the core has an inlet for receiving the fluid core material the configuration being such as to provide a gradient of injection pressure which decreases from a first injection pressure at a first position proximal to the inlet and a second injection pressure at a second position distal to the inlet and the arrangement of the pedestal array being such that the separation of the pedestals increases between the first position and the second position.

To ensure conforming core geometry, it is important to ensure good flow of the fluid core material around the core die to provide the correct channel geometry. From a blade design perspective, it is desirable that the pedestals are in close proximity to each other. At higher injection pressures, fluid core material can be more easily forced through small gaps between the pedestals, as the injection pressure decreases, it becomes more difficult and the risk of incomplete fill of the core material around the pedestals is increased. By increasing the separation of pedestals in regions of lower injection pressure, it is made easier for the fluid core material to pass through the gaps and properly fill the core die.

The invention provides component body designs which are optimised to both provide efficient cooling of the component and a more reliable casting method which may reduce the incidence of scrappage. The method is applicable generally to cast components incorporating a core geometry which includes pedestals. Examples of components which might benefit from manufacture by the method of the invention include (without limitation) blades, guide vanes and seal segments.

In one specific embodiment, the component body is a blade of a gas turbine engine which may be a turbine blade associated with a rotor of the turbine or a nozzle guide vane associated with a stator of the gas turbine engine. In this embodiment, the method comprises;

providing a mould defining the external geometry of the blade body;

providing a core defining an internal geometry of the blade body, the core comprising a main body defining an internal chamber of the blade body and having a root end and a tip end and an array of pedestals extending between opposing walls of the internal chamber;

casting a molten material between the mould and the core; and removing the core after the molten material has solidified, wherein, a core die for providing the core has an inlet for receiving the fluid core material the configuration being such as to provide a gradient of injection pressure which decreases from a first injection pressure at a first position proximal to the inlet and a second injection pressure at a second position distal to the inlet and the arrangement of the pedestal array being such that the separation of the pedestals increases between the first position and the second position.

In a particular embodiment, the pedestal array is provided adjacent a trailing edge of the blade. The blade may include a substantially V-shaped trailing edge wall and pedestals extending between oppositely facing extents of the V-shaped trailing edge wall. In such an arrangement, the core die and blade may include pedestals that extend continuously between the oppositely facing V-shaped wall extents providing a symmetrical pattern of pedestals on the oppositely facing walls. Alternatively, pedestals may extend just partway into the chamber from each or one of the V-shaped wall extents. This permits a non-symmetrical arrangement of pedestals.

The pedestals may have any practical cross-sectional shape. For example (but without limitation) the cross-sectional shape is circular, elliptical or racetrack. Preferably the cross-sectional shape does not include tight radii. The pedestals may be inclined with respect to a surface of the blade/core die.

The separation of the pedestals may increase gradually between adjacent pairs of pedestals, or step up between grouped pedestal sections. The separation increase may be in any direction or combination of directions. The pedestals may be grouped into columns and the separation increased between the columns in an angular, column-wise or orthogonal to column-wise direction, or any combination thereof.

In some arrangements the pedestal array fans out with increasing distance from the first position towards the second position.

It will be appreciated that different pedestal arrangements may be optimal for different external and core geometries. They will also vary with the location and number of fluid core material inlets in the core die.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE FIGURES

Embodiments will now be described by way of example only, with reference to the Figures, in which.

DETAILED DESCRIPTION OF FIGURES AND EMBODIMENTS

Figure 1:
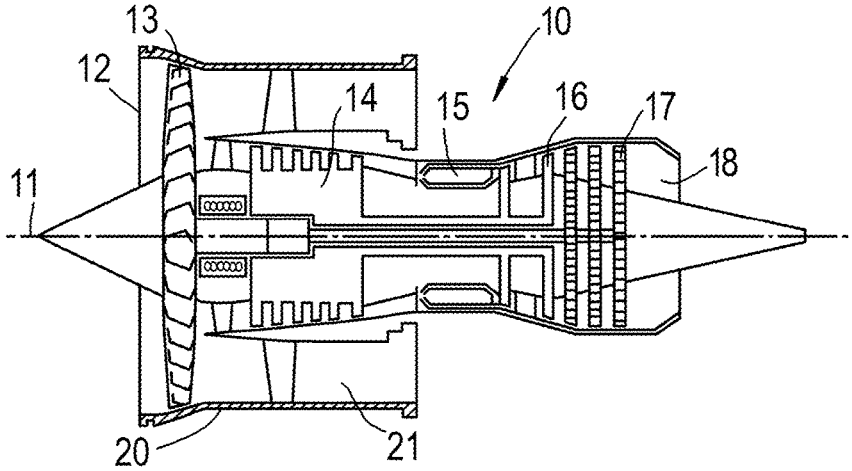
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, a high-pressure compressor 14, combustion equipment 15, a high-pressure turbine 16, a low-pressure turbine 17 and an exhaust nozzle 18. A nacelle 20 generally surrounds the engine 10 and defines the intake 12.

The gas turbine engine 10 works in the conventional manner so that air entering the intake 12 is accelerated by the fan 13 to produce two air flows: a first air flow into the high-pressure compressor 14 and a second air flow which passes through a bypass duct 21 to provide propulsive thrust. The high-pressure compressor 14 compresses the air flow directed into it before delivering that air to the combustion equipment 15.

In the combustion equipment 15 the air flow is mixed with fuel and the mixture combusted. The resultant hot combustion products then expand through, and thereby drive the high and low-pressure turbines 16, 17 before being exhausted through the nozzle 18 to provide additional propulsive thrust. The high 16 and low 17 pressure turbines drive respectively the high pressure compressor 14 and the fan 13, each by suitable interconnecting shaft.

Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

The blades of turbines 16 and 17 are subjected to extremes of temperature by hot gases expelled from the combustion equipment 15. Relatively cool air from the compressor 14 is taken off upstream of the combustion equipment and directed to the turbine section for use as a cooling fluid. Components such as blades of the rotors and stators can be provided with multiple internal channels and arrays of cooling channels in surfaces affected by the heat. The blades can be manufactured using methods in accordance with the invention.

Figure 2:
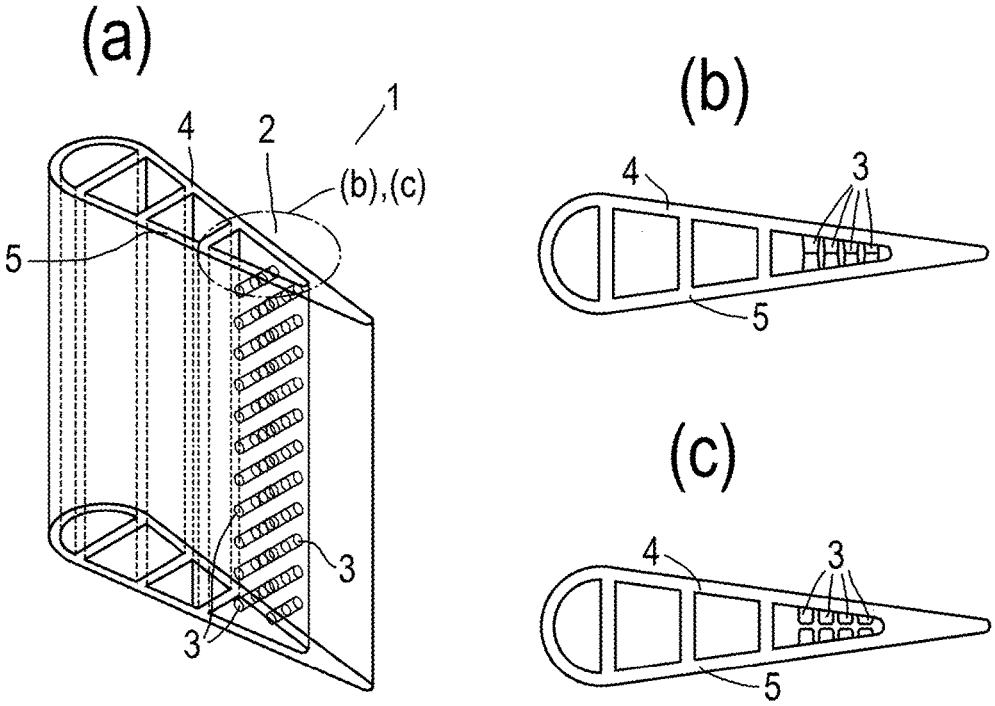
FIG. 2 shows a first array of pedestals known to be used in turbine blades of the prior art.

FIG. 2 shows in schematic, a turbine blade body having a design which is known from the prior art. The image to the left (a) shows a perspective view of the blade. The blade has a terminal trailing edge portion 1 and an adjacent trailing edge portion 2 (encircled). Alternative configurations for pedestal/pin arrays within the adjacent trailing edge portion 2 are shown in a top view in the two images (b) and (c) to the right.

The blade (which has a geometry which corresponds to a core die used to provide the core) includes an array of pedestals 3 aligned in four parallel columns extending along a root to tip direction of the blade chamber. In a direction from leading to trailing edge, pedestals in adjacent columns are staggered to allow the columns to be placed close together.

In one option, as can be seen from the top right hand image (b), pedestals 3 extend between two opposing blade wall sections 4 and 5 so as to provide a symmetrical arrangement of pedestals on the two oppositely facing internal walls. In another option shown in the bottom right hand image (c), two sets of pedestals (in this configuration sometimes referred to as "pins" though for the avoidance of doubt the term "pedestal" as used in the appended claims is intended to include these "pins") 3 are provided, one extending from each of the two opposing wall sections 4 and 5.

Figure 3:
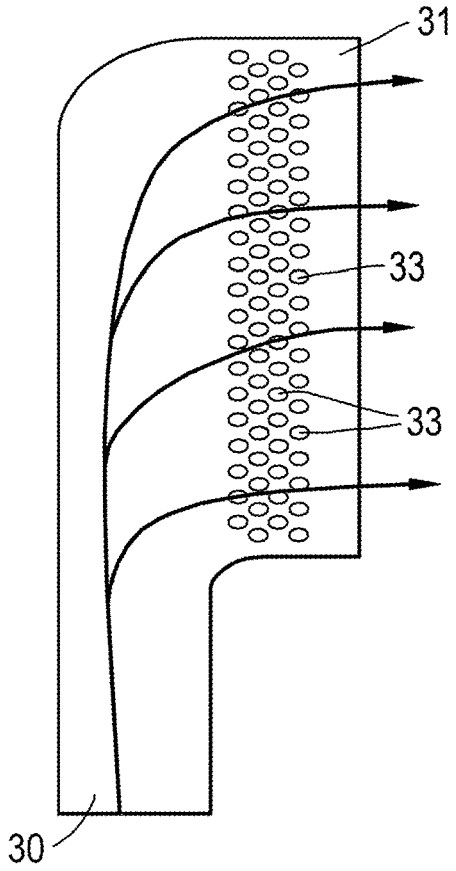
FIG. 3 shows flow of fluid through an array of pedestals in a turbine blade/core die as is known from the prior art.

FIG. 3 shows in schematic a passage adjacent a trailing edge of a turbine blade/core die of a form known in the prior art. As can be seen the passage 31 is interrupted by an array of pedestals 33 arranged in the same pattern as the pedestals of FIG. 2. The arrows show the path taken by cooling air or fluid core material entering the passage via an inlet end 30 at a root end of the blade/core die. The pedestals 33 serve to increase the wetted area of the passage allowing more heat transfer from the passage wall faces to the cooling air stream. Additionally, the pedestals may serve to increase pressure losses in the passage. This can be useful when controlling the rate of cooling air leaving the passage to join the main working fluid flow in the turbine.

Figure 4:
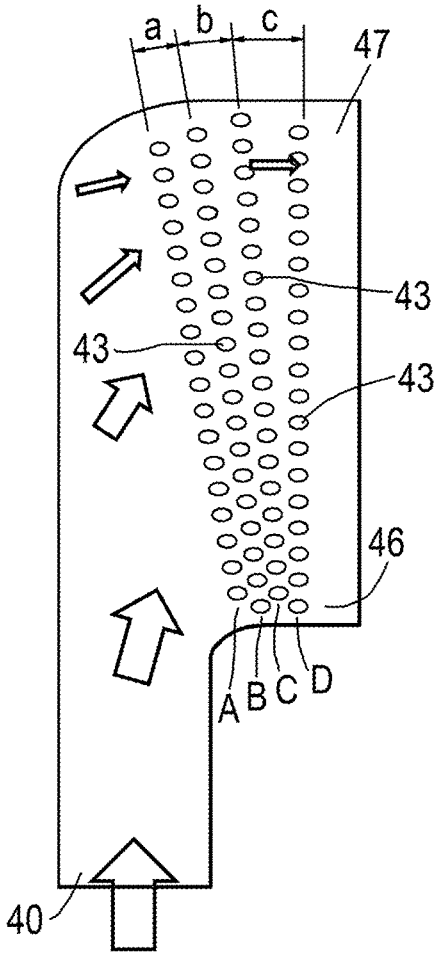
FIG. 4 shows a first embodiment of an array of pedestals in a turbine blade/core die made in accordance with a method of the invention.

FIG. 4 shows in schematic a section view of a first embodiment of a core suited to use in a method in accordance with the invention. As for FIG. 3, the core die defines a core configured for providing a chamber adjacent a trailing edge of a turbine blade. The core die is provided with an array of pedestals 43 arranged in four columns A, B, C, D. The pedestals can be understood to be extending out of the page and will define holes passing through the core. An inlet 40 for fluid core material is adjacent a root end of the core die. The arrows represent the direction of flow of fluid core material during the core injection process and also the magnitude of the injection pressure of the flowing material. As can be seen, the injection pressure decreases downstream of the inlet 40. To enable the lower pressure flow to flow more easily between the pedestals, the spaces between adjacent columns are increased in a root to tip direction. Adjacent the inlet end in section 46, the columns are closely packed and separated by a small and equal space. The columns then span out gradually in a root to tip direction. It will be appreciated from the arrows that the flow turns as it approaches the tip from a root to tip direction to a leading edge to trailing edge direction. At the tip end 47, the columns A, B, C, D are separated by spaces a, b, c which gradually increase in size from the leading edge to trailing edge direction, b being greater than a and c being greater than b.

Figure 5:
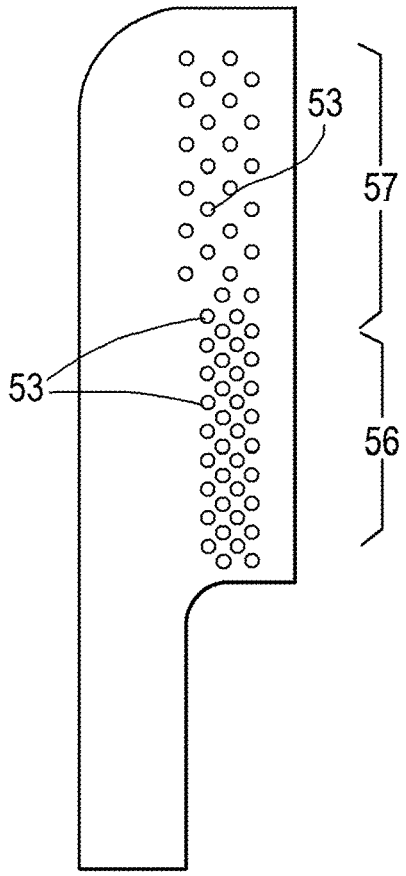
FIG. 5 shows a second embodiment of an array of pedestals in a turbine blade/core die made in accordance with a method of the invention.

FIG. 5 shows in schematic a section view of a second embodiment of a core die suited to use in a method in accordance with the invention. As for the embodiment of FIG. 4, the core die is provided with an array of pedestals 53 arranged in four columns. In a root to tip direction, the columns are divided into two sections. At the inlet end section 56, the columns are closely packed and separated by a small and equal space. At the end 57 distal from the inlet, the columns remain in substantially parallel alignment but are separated by larger spaces in both a root to tip and a leading edge to trailing edge direction which is approximately 1.5 to 2 times the equivalent space in the inlet end section 56. More generally, in embodiments of the invention, the spacing will be calculated based on the expected pressure drop around the core die as per the embodiments.

Figure 6:
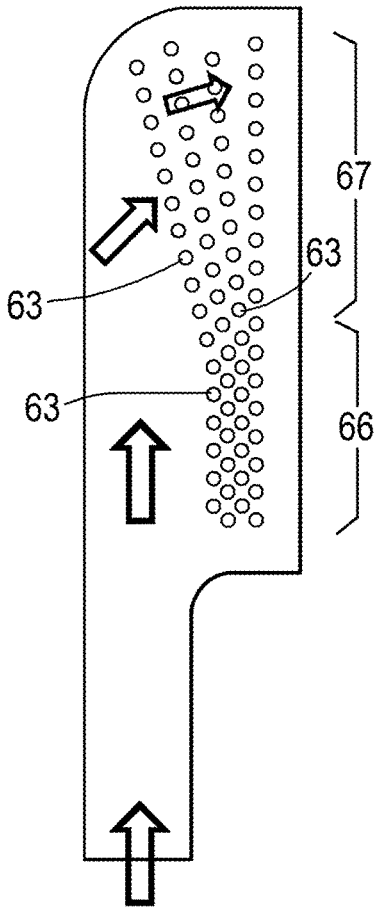
FIG. 6 shows a third embodiment of an array of pedestals in a turbine blade/core die made in accordance with a method of the invention.

FIG. 6 shows in schematic a section view of a third embodiment of a core die suited to use in a method in accordance with the invention. As for the embodiment of FIG. 4, the core die is provided with an array of pedestals 63 arranged in four columns. In a root to tip direction, the columns are divided into two sections. At the inlet end section 66, the columns are closely packed and separated by a small and equal space. In the distal end section 67, the columns gradually fan out from a trailing edge side towards a leading edge side at substantially equal angular separations.

Figure 7:
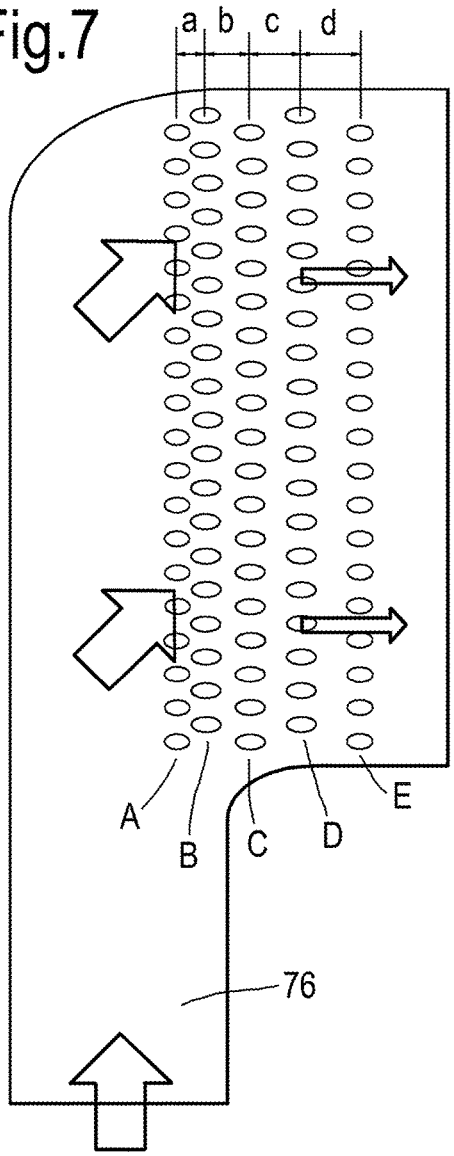
FIG. 7 shows a fourth embodiment of an array of pedestals in a turbine blade/core die made in accordance with a method of the invention.

FIG. 7 shows in schematic a section view of a fourth embodiment of a core suited to use in a method in accordance with the invention. In this arrangement five columns of pedestals A, B, C, D, E are provided in parallel alignment extending in a root to tip direction. The spaces between the columns a, b, c, d gradually increase with distance from the inlet 76; b being greater than a, c greater than b and d greater than c. This particular arrangement is well suited to blades where a low radial pressure drop, but high chordal pressure drop is expected for a single inlet passage. There is no need to increase spacing at the tip end of the passage as there is still a high injection pressure at this location.

Figure 8:
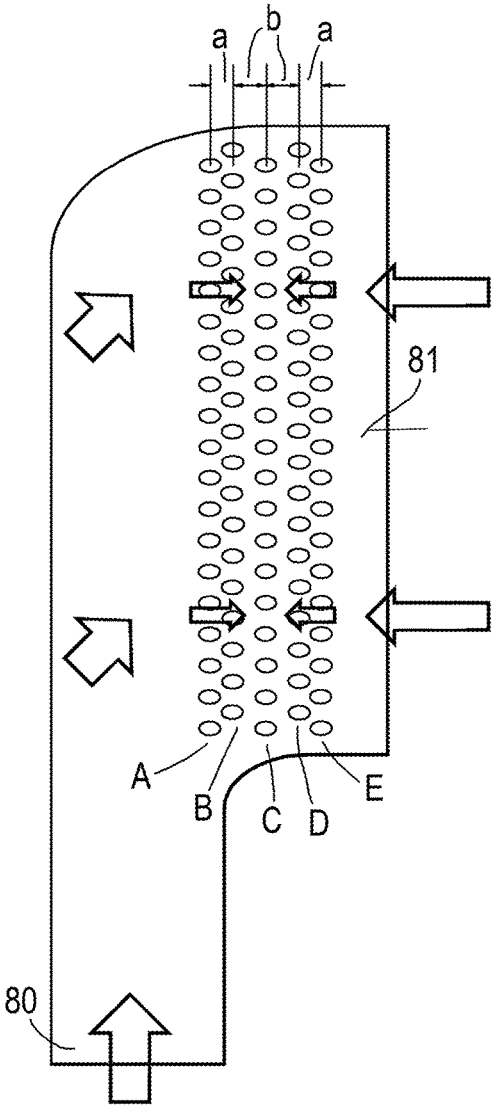
FIG. 8 shows a fifth embodiment of an array of pedestals in a turbine blade/core die made in accordance with a method of the invention.

FIG. 8 shows in schematic a section view of a fifth embodiment of a core suited to use in a method in accordance with the invention. In this arrangement, five columns of pedestals A, B, C, D, E are provided in parallel alignment extending in a root to tip direction. As shown in this Figure, a relatively high inlet pressure occurs both at the inlet end 80 and trailing edge 81, the inlet pressure decreases with distance from these two ends as it approaches the middle column C. As with the arrangement of FIG. 7, low radial pressure drop is expected and so no increased radial spacing is required.

The columns B and D are arranged with a spacing b which is larger than a spacing a between each of column pairs A and B, and D and E.

Figure 9:
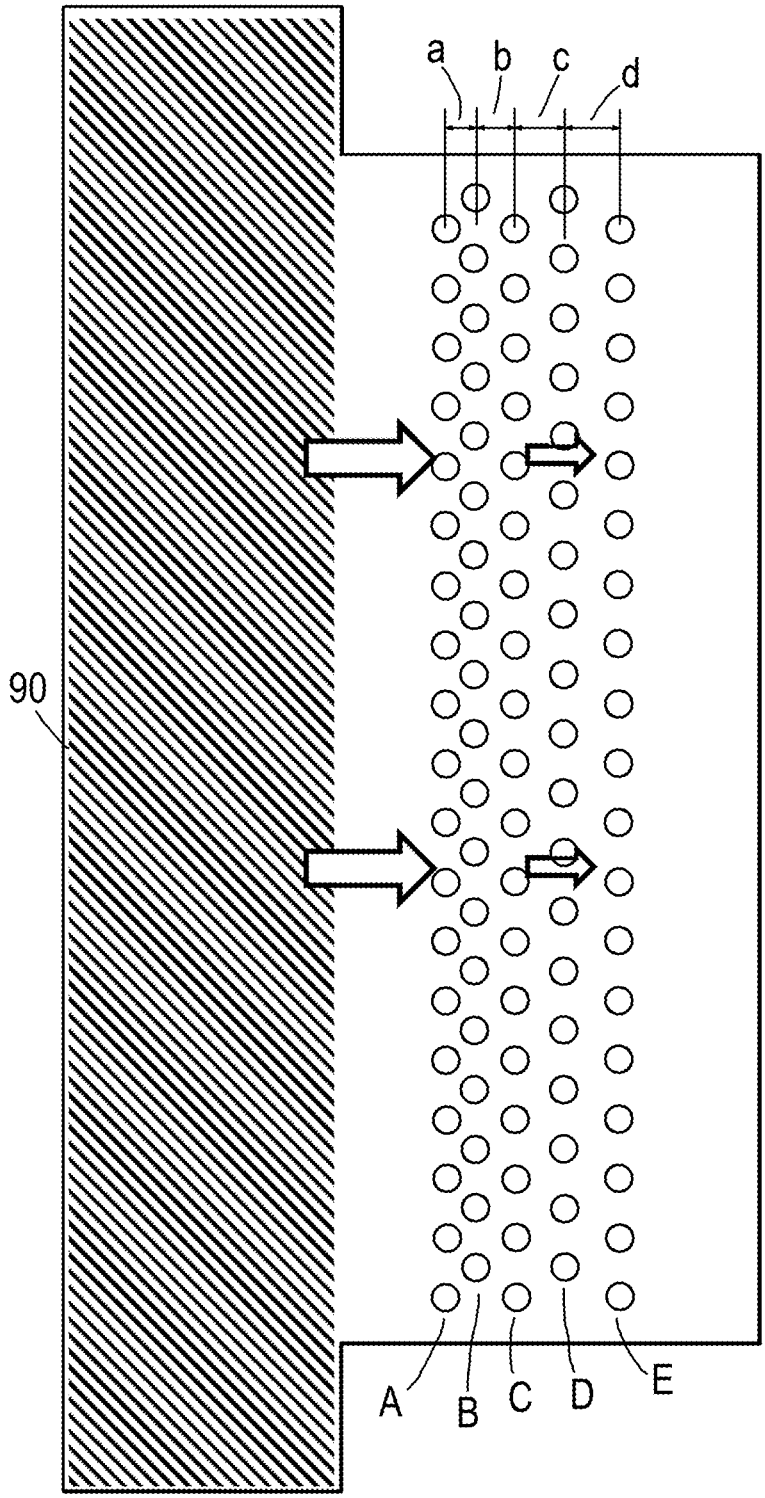
FIG. 9 shows a sixth embodiment of an array of pedestals in a turbine blade/core die made in accordance with a method of the invention.
Figure 10:
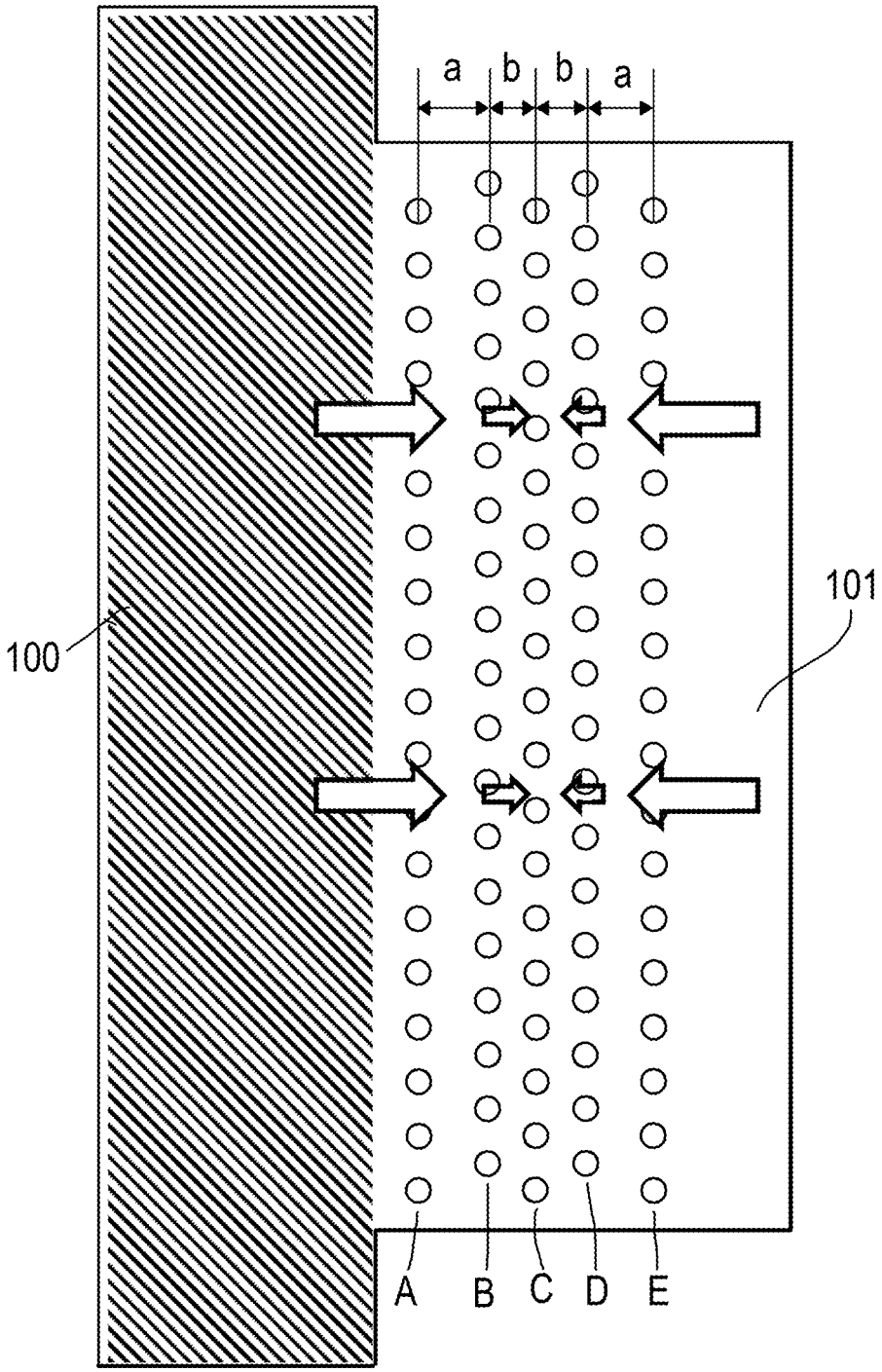
FIG. 10 shows an seventh embodiment of an array of pedestals in a turbine blade/core die made in accordance with a method of the invention.

FIGS. 9 and 10 show in schematic a section view of a sixth and seventh embodiments of a core die suited to use in a method in accordance with the invention. In these embodiments, the core die defines an internal chamber configured for placement adjacent a trailing edge of a nozzle guide vane. FIG. 9 is suited to a casting process where a single fluid core material inlet is provided. FIG. 10 is suited to a process where a fluid core material inlet is provided at two opposite sides of the column array.

Figure 11:
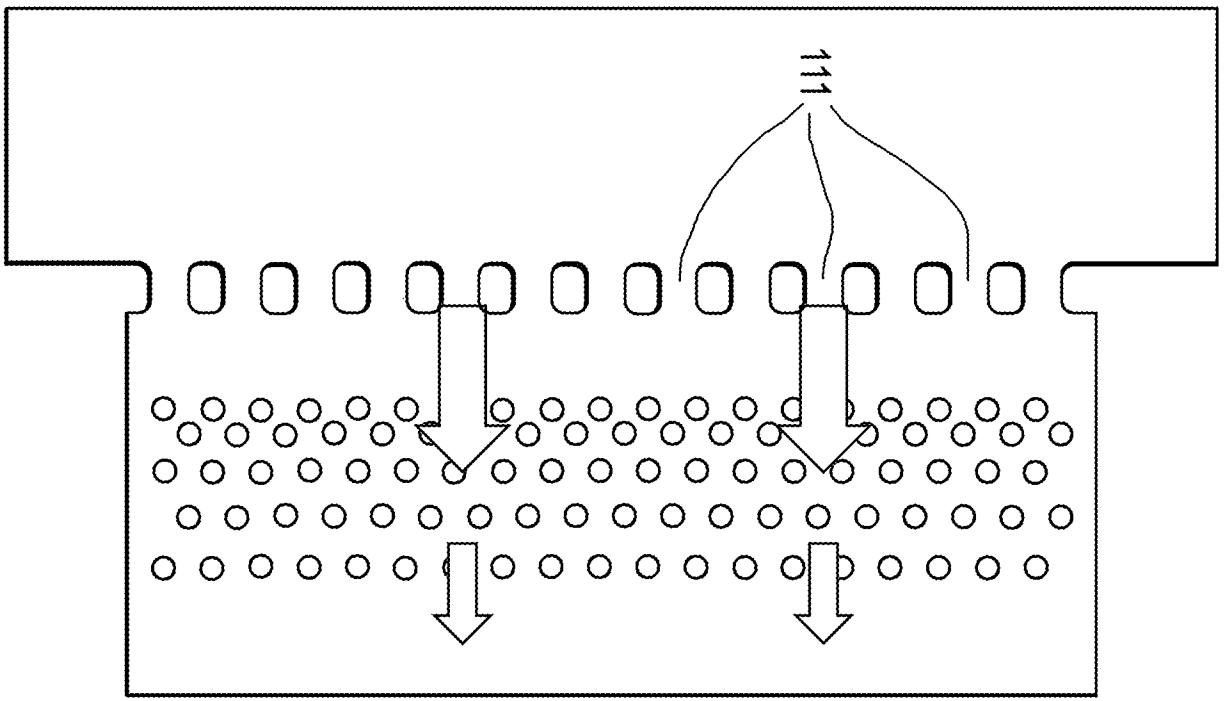
FIG. 11 shows an array of pedestals similar to that of FIG. 9 provided in an alternative blade geometry.
Figure 12:
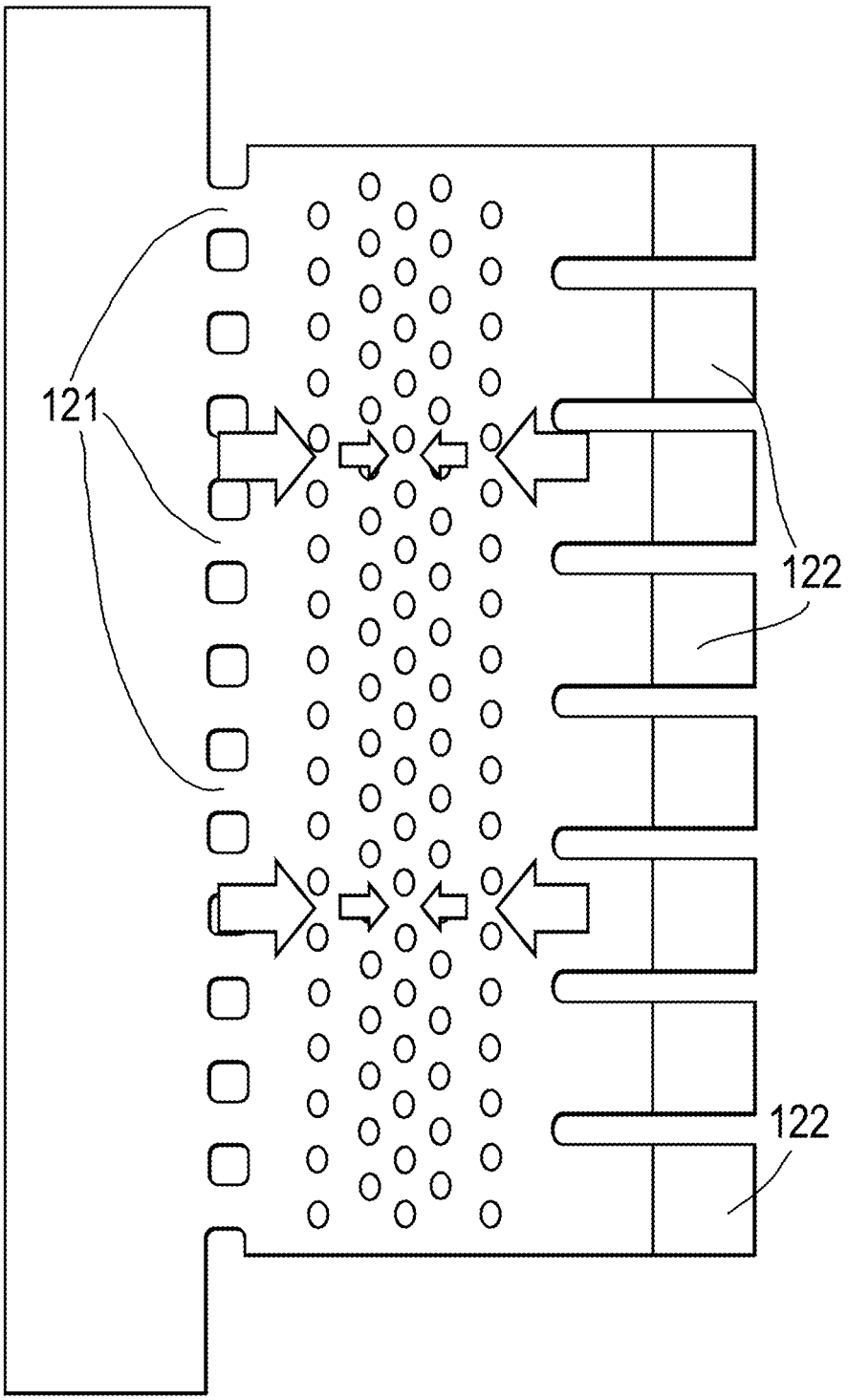
FIG. 12 shows an array of pedestals similar to that of FIG. 10 provided in an alternative blade geometry.

The pedestal array arrangements of FIGS. 9 and 10 will also apply to blade geometries with chordal inlets to the trailing edge passage. FIG. 11 (corresponding to the arrangement of FIG. 9) shows the pedestal array with an impingement system of cooling holes 111 into the trailing edge. FIG. 12 (corresponding to the arrangement of FIG. 10) shows the pedestal array with an impingement system of cooling holes 121 and with cast trailing edge slots 122.

In the arrangement of FIG. 9, five columns of pedestals A, B, C, D, E are provided in parallel alignment extending in a root to tip direction. An inlet 90 directs flow of molten material in an orthogonal (leading edge to trailing edge) direction. The spaces between the columns a, b, c, d gradually increase with distance from the inlet and decreasing inlet pressure; b being greater than a, c greater than b and d greater than c.

In the arrangement of FIG. 10, five columns of pedestals A, B, C, D, E are provided in parallel alignment extending in a root to tip direction. As shown in this Figure, a relatively high inlet pressure occurs both at the inlet end 100 and trailing edge inlet 101, the inlet pressures decrease with distance from these two ends as they approach the middle column C, however, their additive effect may be equal or greater than the inlet pressure at columns A and E. The columns B and D are arranged with a spacing b between each and column C which is smaller than a space a between each of column pairs A and B, and D and E.

As will be appreciated from the Figures, separation of pedestals in the arrays can be increased between columns, or rows, or in an angular direction. Whilst not all permutations are illustrated, it is contemplated that any combination of these separation increases could be incorporated to achieve the desired effect and without departing from the invention as claimed herein.

Whilst the figures define the numbers of columns in a pedestal array, it will be understood that the number of columns in an array is not strictly limited to these numbers and may be greater or smaller than the numbers stated.

It will be understood that the invention is not limited to the embodiments above-described and various modifications and improvements can be made without departing from the scope of the appended claims. Except where mutually exclusive, any of the features may be employed separately or in combination with any other features and the disclosure extends to and includes all combinations and sub-combinations of one or more features described herein.

The invention claimed is:

1. A method for casting a turbine component body, the method comprising;

providing a mould defining the external geometry of the component body;

providing a core, using a core die, defining an internal geometry of the component body, the core comprising a main body defining an internal chamber of the component body and an array of pedestals extending between opposing walls of the internal chamber;

casting a molten material between the mould and the core; and removing the core after the molten material has solidified, wherein, the core die for providing the core has an inlet for receiving a fluid core material the configuration being such as to provide a gradient of injection pressure which decreases from a first injection pressure at a first position proximal to the inlet and a second injection pressure at a second position distal to the inlet and the arrangement of the pedestal array being such that the separation of the pedestals increases between the first position and the second position.

2. A method as claimed in claim 1 wherein the component is a blade and the core defines an internal chamber adjacent a trailing edge of the blade.

3. A method as claimed in claim 2 wherein the blade is a turbine blade.

4. A method as claimed in claim 2 wherein the blade is a nozzle guide vane.

5. A method according to claim 2 wherein the blade includes a substantially V-shaped trailing edge wall and the pedestals extend between oppositely facing extents of the V-shaped trailing edge wall and extend continuously between the oppositely facing V-shaped wall extents providing a symmetrical pattern of pedestals on the oppositely facing walls.

6. A method as claimed in claim 1 wherein the pedestals have a cross-sectional shape selected from; circular, elliptical or racetrack or any combination thereof.

7. A method as claimed in claim 1 wherein the pedestals are inclined with respect to an internal surface of a wall of the component.

8. A method as claimed in claim 1 wherein the separation of the pedestals increases gradually between adjacent pairs of pedestals.

9. A method as claimed in claim 1 wherein the separation steps up between grouped pedestal sections.

10. A method as claimed in claim 1 wherein the pedestals are grouped into columns and the separation increases between the columns in an angular, column-wise or orthogonal to column-wise direction, or any combination thereof.

11. A method as claimed in claim 1 wherein the pedestal array fans out with increasing distance from the first position towards the second position.

12. A method as claimed in claim 1 wherein the step of providing the core involves delivering the fluid core material through at least two inlets to a core die, the inlets arranged on opposite sides of the pedestal array and the second position is in a central region of the array.

13. A method as claimed in claim 1 wherein the step of providing the core involves delivering fluid core material through a single inlet on a first side of the pedestal array and the second position is on a second side of the pedestal array.

14. A method as claimed in claim 1 wherein, during the step of providing the core the flow of the fluid core material turns between the first position and second position and the separation of the pedestals increases in two directions which follow the flow direction adjacent the first and second positions.

15. A core die for providing a core for a turbine component body, the component body including an array of pedestals extending between opposing walls of an internal chamber defined by the core; the core die having an inlet for receiving a fluid core material the configuration being such as to provide a gradient of injection pressure which decreases from a first injection pressure at a first position proximal to the inlet and a second injection pressure at a second position distal to the inlet and the arrangement of the pedestal array being such that the separation of the pedestals increases between the first position and the second position.

* * * * *